US011384933B2

(12) United States Patent
Koyama et al.

(10) Patent No.: US 11,384,933 B2
(45) Date of Patent: Jul. 12, 2022

(54) BURNER DEVICE, COOLING PIPE BREAKAGE DETECTION METHOD OF BURNER DEVICE, AND REFRIGERANT CONTROL METHOD OF BURNER DEVICE

(71) Applicant: Mitsubishi Hitachi Power Systems, Ltd., Yokohama (JP)

(72) Inventors: Yoshinori Koyama, Tokyo (JP); Katsuhiko Yokohama, Tokyo (JP); Yasunari Shibata, Yokohama (JP)

(73) Assignee: MITSUBISHI POWER, LTD., Yokohama (JP)

( * ) Notice: Subject to any disclaimer, the term of this patent is extended or adjusted under 35 U.S.C. 154(b) by 457 days.

(21) Appl. No.: 16/340,510

(22) PCT Filed: Apr. 27, 2017

(86) PCT No.: PCT/JP2017/016740
§ 371 (c)(1),
(2) Date: Apr. 9, 2019

(87) PCT Pub. No.: WO2018/073998
PCT Pub. Date: Apr. 26, 2018

(65) Prior Publication Data

US 2019/0242574 A1 Aug. 8, 2019

(30) Foreign Application Priority Data

Oct. 21, 2016 (JP) ..... JP2016-206474

(51) Int. Cl.
*F23D 14/78* (2006.01)
*F17D 5/06* (2006.01)
(Continued)

(52) U.S. Cl.
CPC ..... *F23D 14/78* (2013.01); *C10J 3/50* (2013.01); *F17D 5/06* (2013.01); *F23D 1/04* (2013.01); *F23D 2214/00* (2013.01)

(58) Field of Classification Search
CPC ..... F23D 14/78
See application file for complete search history.

(56) References Cited

U.S. PATENT DOCUMENTS 3,350,084 A * 10/1967 Lucarell ..... C21B 7/16 266/266
3,743,606 A * 7/1973 Marion et al. ..... C01B 3/363 252/373

(Continued)

FOREIGN PATENT DOCUMENTS

CN 102171514 A 8/2011
JP 55-131739 A 10/1980

(Continued)

OTHER PUBLICATIONS

International Search Report dated Aug. 1, 2017, issued in Application No. PCT/JP2017/016740 (9 pages).

(Continued)

*Primary Examiner* — Avinash A Savani
*Assistant Examiner* — Deepak A Deean
(74) *Attorney, Agent, or Firm* — WHDA, LLP

(57) ABSTRACT

A burner device includes a burner body which includes a protruding portion protruding from a furnace wall into an interior of a combustion furnace, a cooling pipe through which a refrigerant for cooling the burner body flows, the cooling pipe being disposed so as to surround an outer peripheral surface of the protruding portion, and a light detection unit for detecting internal light of the cooling pipe.

8 Claims, 8 Drawing Sheets

(51) Int. Cl.
*F23D 1/04* (2006.01)
*C10J 3/50* (2006.01)

(56) References Cited

U.S. PATENT DOCUMENTS 3,847,564 A * 11/1974 Marion ..... C01B 3/363 48/95
4,319,479 A 3/1982 Iwamura et al.
4,525,175 A * 6/1985 Stellaccio ..... C10J 3/506 239/132.3
4,743,194 A 5/1988 Stellaccio
4,887,800 A * 12/1989 Hotta ..... C21B 7/16 266/270
5,005,005 A * 4/1991 Brossia ..... B64D 15/20 250/573
5,261,602 A * 11/1993 Brent ..... C01B 3/363 110/347
5,515,794 A * 5/1996 Kassman ..... C10J 3/50 110/261
8,997,665 B2 4/2015 Hamasaki et al.
9,422,488 B2 * 8/2016 Kishore ..... F23D 11/36
2005/0238533 A1 * 10/2005 Jansen ..... G01N 31/12 422/54
2012/0240729 A1 * 9/2012 Verscheure ..... C22B 7/003 75/626
2013/0273480 A1 * 10/2013 Santoianni ..... F23L 15/00 431/11
2016/0305658 A1 * 10/2016 Nakata ..... F23N 5/02
2018/0031231 A1 * 2/2018 Zanichelli ..... F23D 14/78
2020/0292383 A1 * 9/2020 Sakamoto ..... G02B 6/02

FOREIGN PATENT DOCUMENTS

JP 57-067106 A 4/1982
JP 63-290326 A 11/1988
JP 2002-161284 A 6/2002
JP 2015-161462 A 9/2015
JP 5818550 B2 11/2015
JP 59-68247 B2 8/2016
JP 5968247 B2 8/2016

OTHER PUBLICATIONS

International Preliminary Report on Patentability (Form PCT/IB/326) issued in counterpart International Application No. PCT/JP2017/016740 dated May 2, 2019, with Form PCT/IB/373, PCT/ISA/237, PCT/IB/338, with English translation (13 pages).
Office Action dated Oct. 8, 2019, issued in counterpart CN Application No. 201780063898.9, with English translation. (10 pages).

* cited by examiner a-a b-b

BURNER DEVICE, COOLING PIPE BREAKAGE DETECTION METHOD OF BURNER DEVICE, AND REFRIGERANT CONTROL METHOD OF BURNER DEVICE

TECHNICAL FIELD

The present disclosure relates to a burner device installed in the interior of a combustion furnace such as a gasification furnace and including a cooling pipe for cooling a burner.

BACKGROUND

As a method of gasifying coal, there is a known airborne layer coal gasification method of supplying powdered solid fuel such as coal and a gasifying agent such as oxygen or air from a burner into a gasification furnace held at an elevated temperature, generating a combustible gas such as carbon monoxide or hydrogen by combusting a combustible content in fuel, converting an ash content into slag without any harmful component, and recovering the slag. This method can obtain a fuel gas with high efficiency, has excellent environmental conservability, and is expected to be utilized for, for example, a next-generation thermal power generation system such as an integrated gasification combined cycle system (IGCC) or an integrated coal gasification fuel cell combined cycle system and a hydrogen producing system used for coal liquefaction, a chemical raw material, or the like because of its many different applicable materials. In addition, the gasification furnace is also used when thermochemically gasifying biomass fuel.

The gasification furnace of this kind used for a gasification plant includes a gasification burner (to be abbreviated as a burner device hereinafter) for injecting powdered solid fuel. The burner device is generally inserted from the exterior of a furnace via a through hole of a furnace wall and is attached to the furnace wall with its tip portion protruding into the interior of the furnace. The tip portion of the burner device inserted into the interior of the furnace may not only be exposed at a high temperature equal to or higher than an ash melting temperature but also be subjected to a large heat load due to adhesion, separation, or the like of molten slag. If the tip portion of the burner device is subjected to the large heat load as described above, for example, erosion and a crack occur in the tip portion, and the tip portion is thinned due to high-temperature corrosion, extremely decreasing a lifetime of the burner device.

To cope with this, for example, in Patent Documents 1 to 3, the circumference of a burner body is surrounded by a cooling pipe through which cooling water flows in order to cool the burner body. More specifically, in Patent Documents 1 to 3, the cooling pipe is disposed in contact with the burner body to be spirally wound around a portion protruding from a furnace wall into the interior of a gasification furnace (to be referred to as a furnace protruding portion hereinafter) in the burner body of the burner device. In Patent Document 3, of cooling pipes provided for the burner body, a cooling pipe positioned between a base portion (root) of the furnace protruding portion and a side of the exterior of the furnace, and a cooling pipe disposed on the furnace protruding portion may serve as refrigerant systems independent of each other.

CITATION LIST

Patent Literature

Patent Document 1: JP2015-161462A

Patent Document 2: JP5818550B

Patent Document 3: JP5968247B

SUMMARY

Technical Problem

In Patent Documents 1 to 3, the furnace protruding portion of the burner device is protected from a heat load during operation of a combustion furnace by surrounding the burner body with the cooling pipe as described above. However, since a temperature in the furnace becomes very high during the operation, the cooling pipe disposed on the furnace protruding portion is gradually worn due to radiation and a thermal current caused by flame in the furnace, molten slag generated in the furnace, or the like. As a result, a refrigerant flowing through the inside of the cooling pipe may leak into the furnace. Then, if a leakage amount of the refrigerant leaking from the cooling pipe into the furnace increases, the combustion furnace has to be stopped in order to replace the cooling pipe, the burner device, or the like, decreasing the operation rate of the combustion furnace (plant).

To cope with this, in order to suppress a decrease in operation rate of the combustion furnace as much as possible, the present inventors also consider reducing (decreasing) the amount of the refrigerant flowing through the cooling pipe in order to reduce the amount of the refrigerant leaking into the furnace. With this method, a shutdown of the combustion furnace can be delayed without an immediate shutdown thereof, making it possible to prepare maintenance works such as arrangements for replacements and the like during the delay. Hence, the combustion furnace need to only be stopped during a time needed for actual maintenance works, making it possible to suppress the decrease in operation rate by a shortened shut-down time. However, not only the worn cooling pipe but also the entire burner device, or the burner body may be damaged.

In view of the above, an object of at least one embodiment of the present invention is to provide a burner device which can suppress the decrease in operation rate of the combustion furnace caused by maintenance of the burner device while avoiding damage to the burner body.

Solution to Problem (1) A burner device according to at least one embodiment of the present invention includes a burner body which includes a protruding portion protruding from a furnace wall into an interior of a combustion furnace, a cooling pipe through which a refrigerant for cooling the burner body flows, the cooling pipe being disposed so as to surround an outer peripheral surface of the protruding portion, and a light detection unit for detecting internal light of the cooling pipe.

During operation of the combustion furnace, if the cooling pipe is worn and gets a hole due to radiation and a thermal current caused by flame in the furnace, slag generated in the furnace, or the like, light generated by combustion (flame) in the furnace reaches inside the cooling pipe. With the above configuration (1), since the burner device includes the light detection unit for detecting the internal light of the cooling pipe, making it possible to detect occurrence of breakage (hole) in the cooling pipe at an early stage by monitoring light detected by the light detection unit.

In addition, if the amount of the refrigerant leaking from the cooling pipe excessively increases, a shutdown of the combustion furnace is inevitable. However, occurrence of breakage (hole) in the cooling pipe is detected at the early stage, making it possible to place a moratorium from the detection to the shutdown of the combustion furnace.

Accordingly, maintenance works such as preparation for replacements and specifying a portion to be checked are prepared in the moratorium, making it possible to shorten a non-operation time of the combustion furnace as compared with a case in which the maintenance works are prepared, and actual maintenance works are done after stopping the combustion furnace. Therefore, the combustion furnace is stopped before damaging the burner body, making it possible to suppress a decrease in operation rate of the combustion furnace caused by maintenance of the burner device while avoiding damage to the burner body.

(2) In some embodiments, in the above configuration (1), the light detection unit includes a light transmission member for transmitting light, the light transmission member being installed inside the cooling pipe and a light detector detecting inner light from the cooling pipe, the inner light being transmitted by the light transmission member.

With the above configuration (2), the internal light of the cooling pipe is transmitted to the light detector by the light transmission member, and the light detector detects the internal light of the cooling pipe, monitoring and detecting breakage (hole) of the cooling pipe during the operation of the combustion furnace. Thus, the light detection unit can appropriately detect the internal light of the cooling pipe without installing the light detector in a high-temperature environment in the furnace, making it possible to appropriately detect breakage (hole) of the cooling pipe during the operation of the combustion furnace.

(3) In some embodiments, in the above configuration (2), the light transmission member is an optical fiber.

With the above configuration (3), it is possible to appropriately transmit light in the cooling pipe to the light detector by installing an optical fiber which can endure a high-temperature environment of the combustion furnace.

(4) In some embodiments, in the above configuration (3), the optical fiber includes a plurality of optical fibers, and respective distal ends of the plurality of optical fibers are disposed at different positions from each other in the cooling pipe.

With the above configuration (4), the plurality of optical fibers can respectively monitor presence/absence of occurrence of breakage (hole) at a plurality of different positions from each other in the cooling pipe, making it possible to detect, with a higher sensitivity, a change in light generated by occurrence of breakage (hole) of the cooling pipe. (5) In some embodiments, in any one of the above configurations (2) to (4), the cooling pipe includes a tip-side cooling pipe through which a refrigerant for cooling the burner body flows, the tip-side cooling pipe being disposed so as to surround a tip-side region including a tip portion on an outer peripheral surface of the furnace protruding portion, and a base-side cooling pipe through which the refrigerant flows, the base-side cooling pipe being disposed so as to surround a base-side region between the tip-side region and a base portion on the outer peripheral surface of the furnace protruding portion, and the light transmission member is installed inside the tip-side cooling pipe.

The present inventors found that during the operation of the combustion furnace, breakage (hole) of the cooling pipe owing to radiation and the thermal current caused by flame in the furnace, the molten slag generated in the furnace, or the like mainly occurs in a portion surrounding the tip-side region of the furnace protruding portion.

With the above configuration (5), the light transmission member (for example, the optical fiber) is installed inside the tip-side cooling pipe surrounding the tip-side region of the furnace protruding portion. Therefore, it is possible to monitor breakage of the cooling pipe only in a part with a higher possibility of breakage, making it possible to efficiently detect breakage of the cooling pipe during the operation of the combustion furnace at an early stage. The tip-side cooling pipe and the base-side cooling pipe may be cooling pipes connected to each other or may be cooling pipes independent of each other.

(6) In some embodiments, in the above configuration (5), the burner device further includes a first refrigerant supply pipe for supplying the refrigerant to the tip-side cooling pipe and a second refrigerant supply pipe for supplying the refrigerant to the base-side cooling pipe.

With the above configuration (6), the furnace protruding portion of the burner body includes two cooling systems; a cooling system (the tip-side cooling pipe and the first refrigerant supply pipe) for cooling the tip-side region and a cooling system (the base-side cooling pipe and the second refrigerant supply pipe) for cooling the base-side region. Therefore, replacement or the like of only the tip-side cooling pipe can be made, making it possible to efficiently do maintenance works and to further suppress the decrease in operation rate of the combustion furnace owing to maintenance of the burner device.

(7) A breakage detection method according to at least one embodiment of the present invention is a cooling pipe breakage detection method of a burner device for detecting breakage of a cooling pipe of the burner device according to any one of the above (1) to (4), the method including a burner body cooling step of supplying the refrigerant to the cooling pipe, a cooling pipe internal light monitoring step of monitoring internal light of the cooling pipe by the light detection unit, and a breakage determination step of determining, based on a monitoring result by the cooling pipe internal light monitoring step, whether breakage occurs in the cooling pipe.

With the above configuration (7), it is possible to achieve the same effect as the above (1).

(8) A refrigerant control method of a burner device according to at least one embodiment of the present invention is a refrigerant control method of a burner device for controlling supply of a refrigerant to a cooling pipe of the burner device according to the above (6), the method including a tip-side region cooling step of supplying the refrigerant from the first refrigerant supply pipe to the tip-side cooling pipe, a base-side region cooling step of supplying the refrigerant from the second refrigerant supply pipe to the base-side cooling pipe, a cooling pipe internal light monitoring step of monitoring internal light of the cooling pipe by the light detection unit, a breakage determination step of determining, based on a monitoring result by the light monitoring step, whether breakage occurs in the tip-side cooling pipe, and a tip-side region cooling stop step of stopping only supply of the refrigerant to the tip-side cooling pipe if it is determined in the breakage determination step that breakage occurs in the tip-side cooling pipe.

With the above configuration (8), it is possible to continue cooling the burner body by the base-side cooling pipe while stopping leakage of the refrigerant to the furnace by stopping only supply of the refrigerant to the tip-side cooling pipe. In other words, it is possible to delay a shutdown of the combustion furnace without an immediate shutdown thereof while avoiding heat damage to the burner body by cooling with the base-side cooling pipe, to further extend a moratorium from detection of leakage of the refrigerant from the tip-side cooling pipe to the shutdown of the combustion furnace, and to take a sufficient time for preparing maintenance.

Advantageous Effects

According to at least one embodiment of the present invention, a burner device is provided, which can suppress a decrease in operation rate of a combustion furnace caused by maintenance of a burner device while avoiding damage to a burner body.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
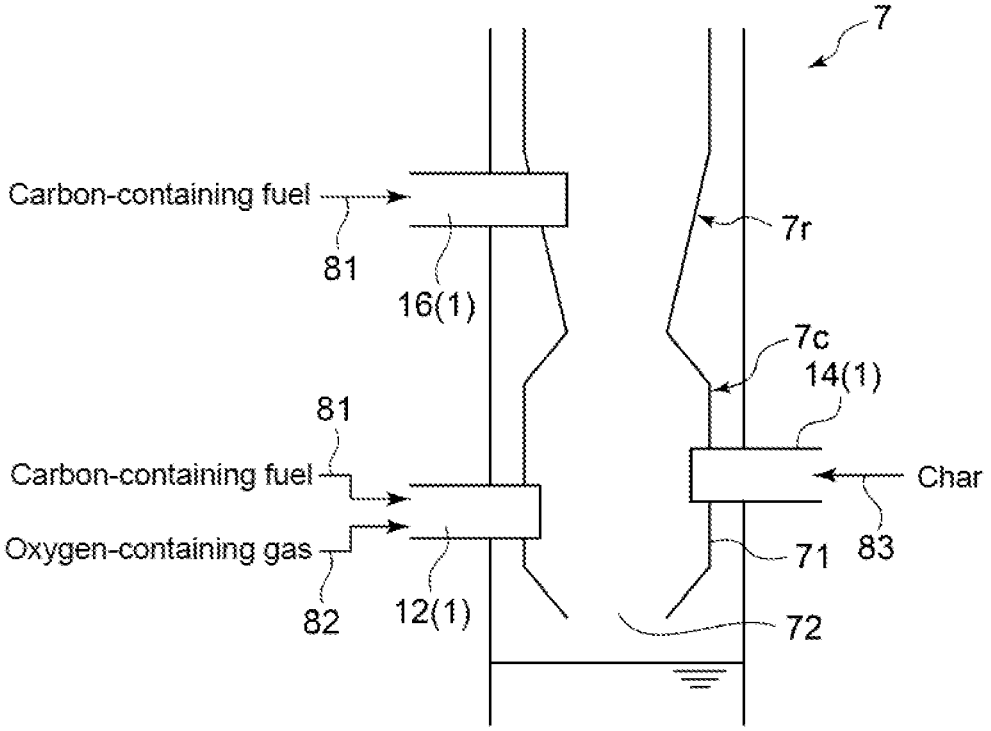
FIG. 1 is a schematic cross-sectional view of a combustion furnace according to an embodiment of the present invention.

FIG. 1 is a schematic cross-sectional view of a combustion furnace 7 including a burner device 1 according to an embodiment of the present invention. The combustion furnace 7 shown in FIG. 1 is a gasification furnace which transforms coal into a gas. The gasification furnace of the embodiment shown in FIG. 1 includes a combustor portion 7*c* and a reductor portion 7*r* as shown in FIG. 1. The combustor portion 7*c* includes a powdered-coal burner 12 and a char burner 14. The reductor portion 7*r* includes a gasification burner 16. The powdered-coal burner 12 is connected to a powdered-coal supply path 81 and an oxidant supply path 82. The powdered-coal supply path 81 supplies coal (powdered coal) powdered as a carbon-containing fuel. The oxidant supply path 82 supplies an oxygen-containing gas (for example, air) as an oxidant. In addition, the char burner 14 is connected to a char supply flow channel 83 supplying char (non-combusted particles). The gasification burner 16 is connected to the above-described powdered-coal supply path 81.

Then, during operation of the gasification furnace, air and coal charged to the combustor portion 7*c* are combusted to a high temperature of 1,800° C. or the like, ash in the coal melts into molten slag (liquid phase) and flows down, and a high-temperature combustible gas generated by combustion in the combustor portion 7*c* flows upward. The high-temperature combustible gas reacts with coal newly charged to the reductor portion 7*r*, making it possible to efficiently transform the coal into a gas. The molten slag is discharged from a discharge port 72 via an inner surface of a furnace wall 71 of the combustion furnace 7. The molten slag discharged from the discharge port 72 is brought into contact with water stored in a bottom part of the combustion furnace 7, thereby being changed to granulated slag and discharged to the exterior of the furnace.

Next, the burner device 1 according to an embodiment of the present invention will be described with reference to FIGS. 2A to 5D.

Figure 2A:
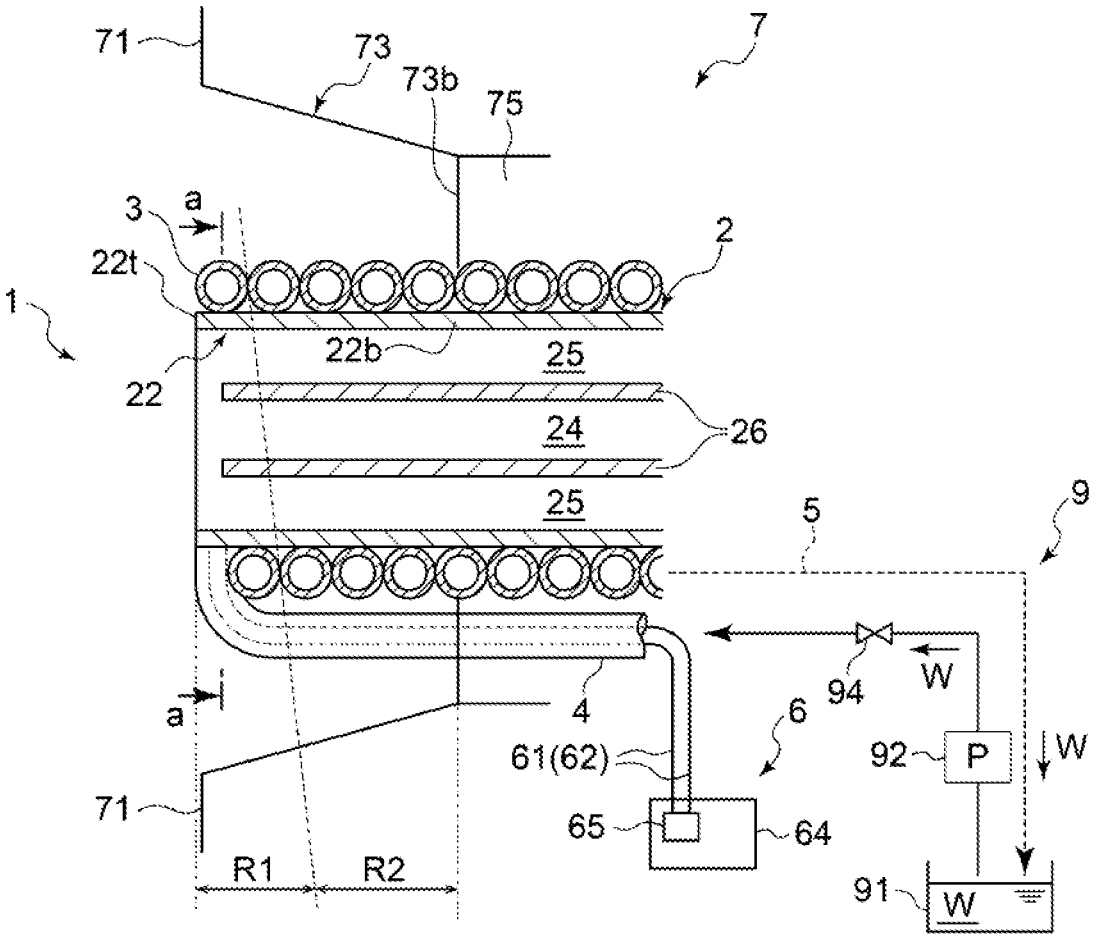
FIG. 2A is an enlarged schematic view of an installation position of a burner device including one cooling pipe in the combustion furnace of FIG. 1, and the burner device protrudes from a recess portion.
Figure 2B:
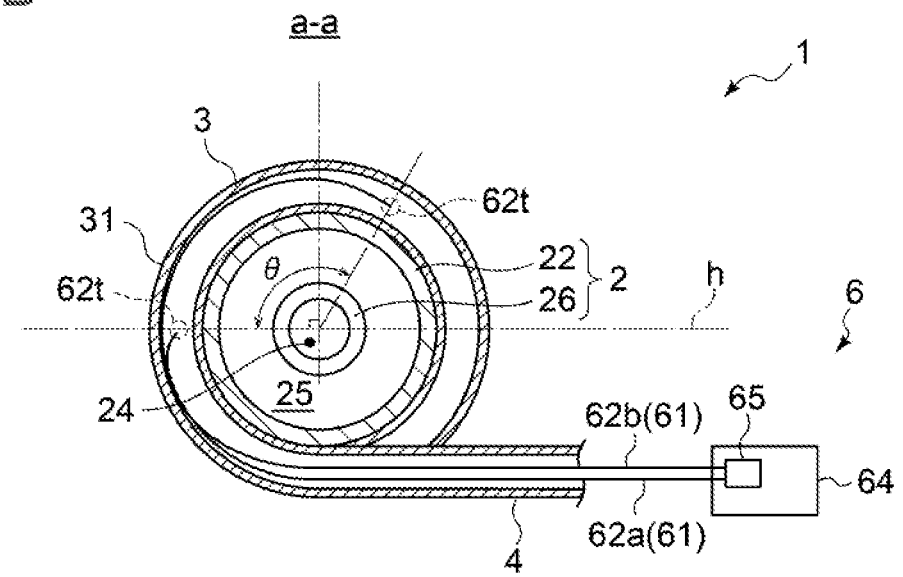
FIG. 2B is a cross-sectional view taken along line a-a of FIG. 2A.
Figure 3A:
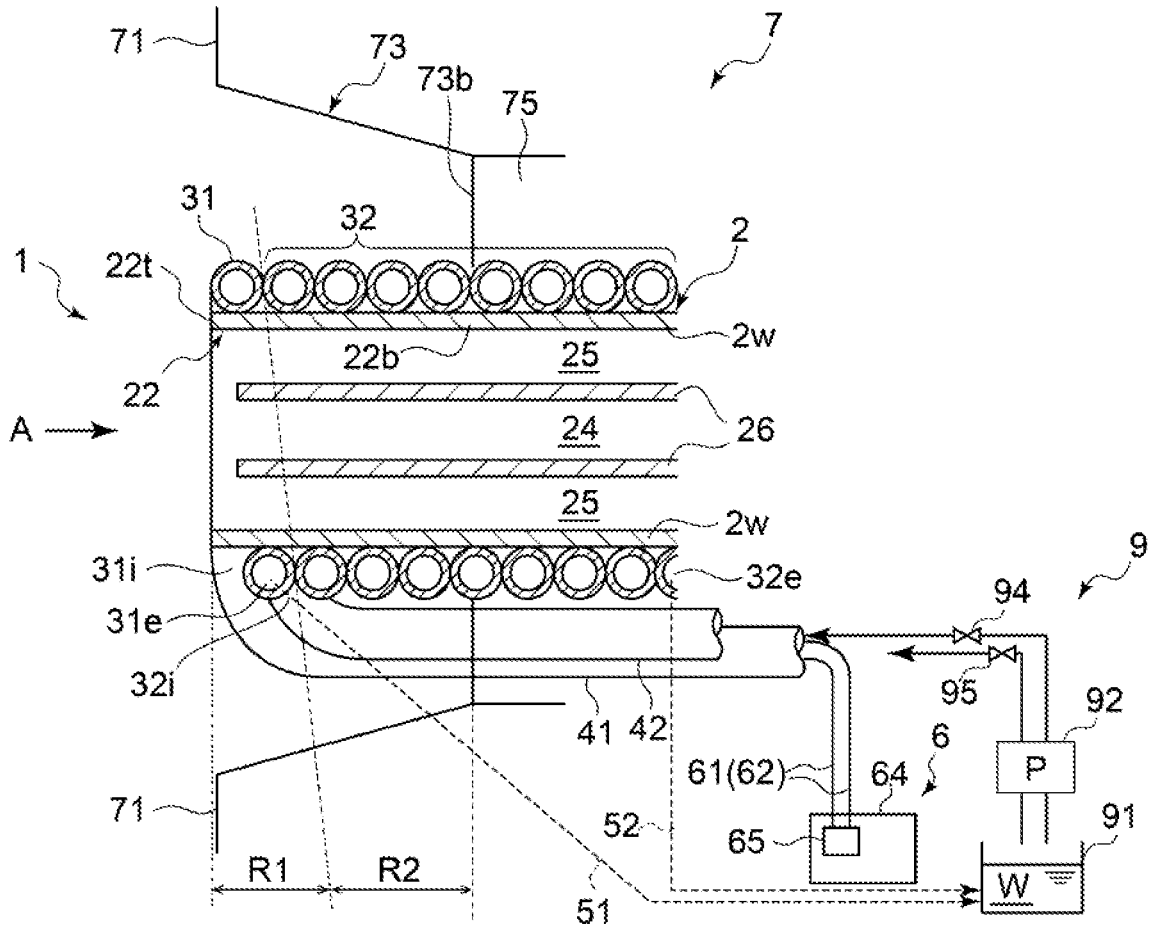
FIG. 3A is an enlarged schematic view of an installation position of the burner device including a plurality of cooling pipes in the combustion furnace of FIG. 1, and the burner device protrudes from the recess portion.
Figure 3B:
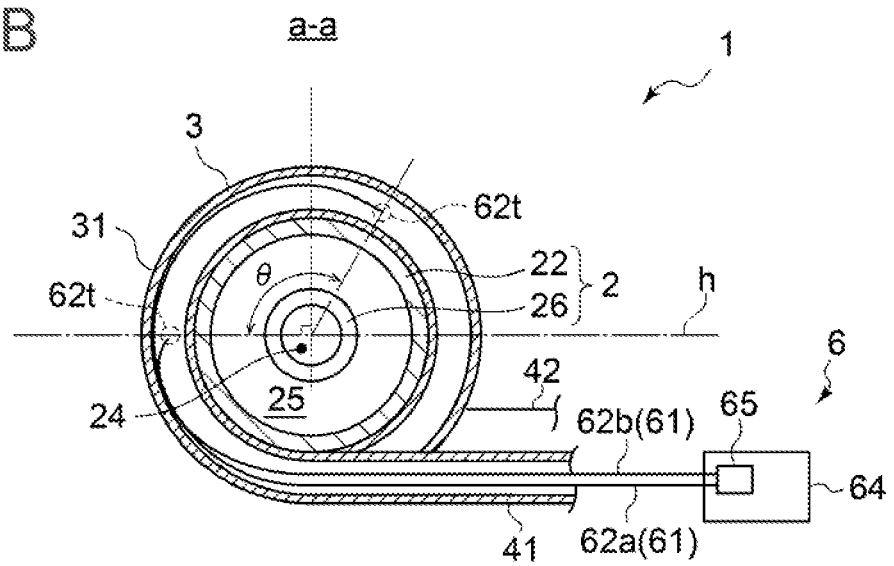
FIG. 3B is a cross-sectional view taken along line a-a of FIG. 3A.
Figure 4:
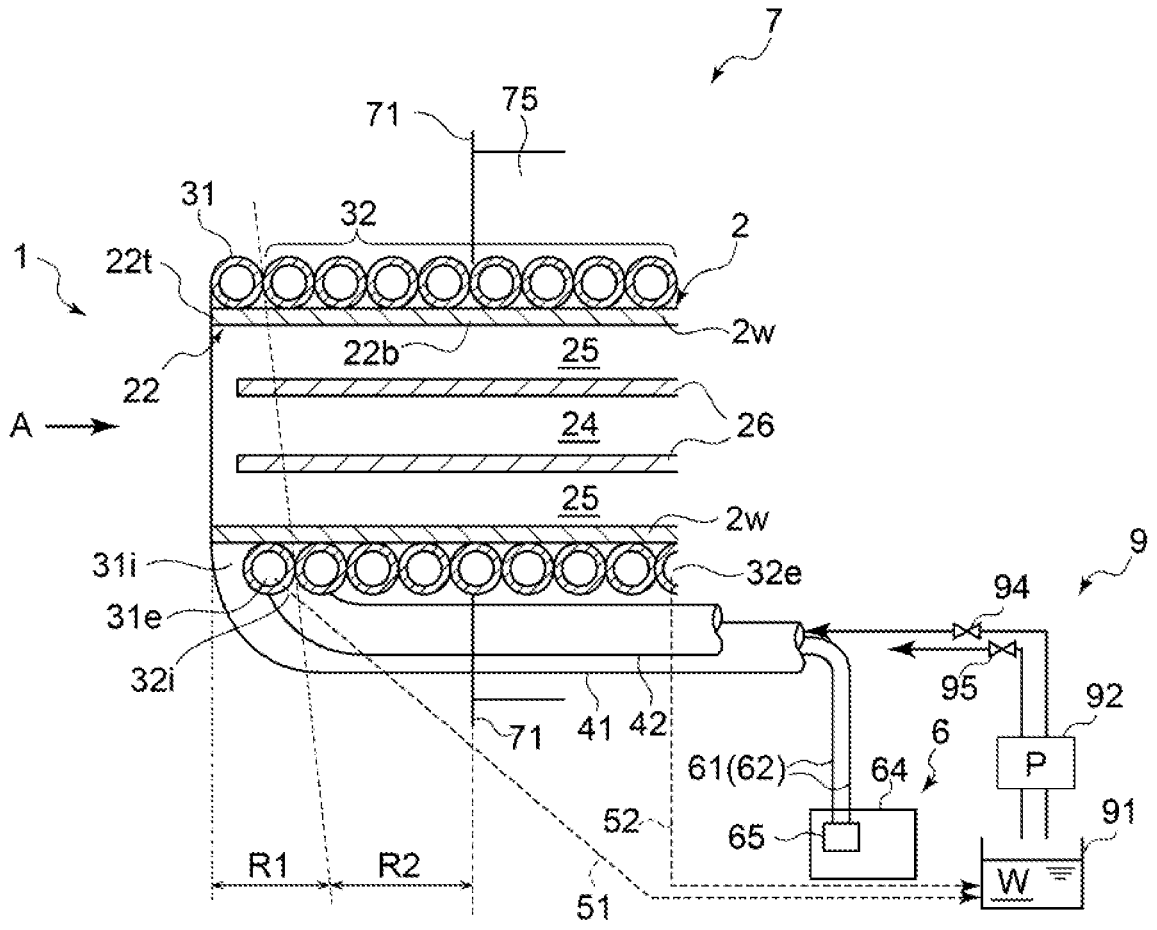
FIG. 4 is an enlarged schematic view of an installation position of the burner device according to an embodiment of the present invention, and the burner device protrudes from not the recess portion but a furnace wall.
Figure 5A:
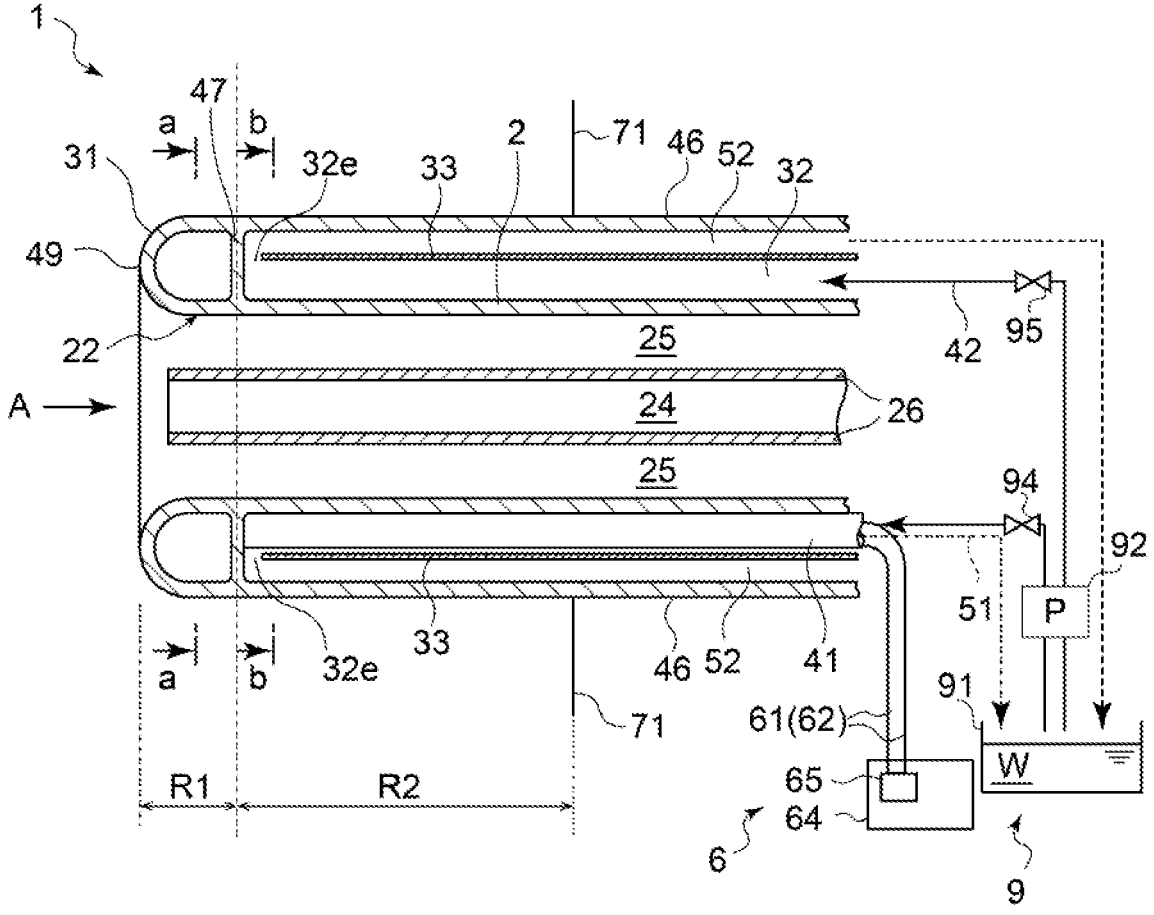
FIG. 5A is an enlarged schematic view of an installation position of the burner device according to an embodiment of the present invention, and the cooling pipe forms a cylindrical flow channel.
Figure 5B:
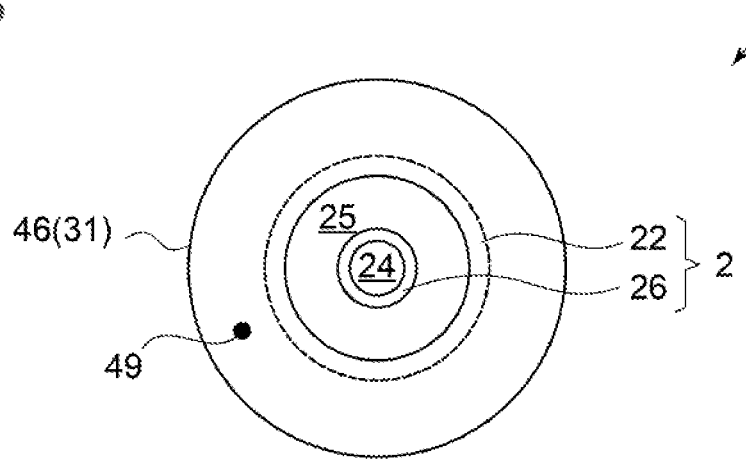
FIG. 5B is a view of FIG. 5A as seen in a direction of an arrow A.
Figure 5C:
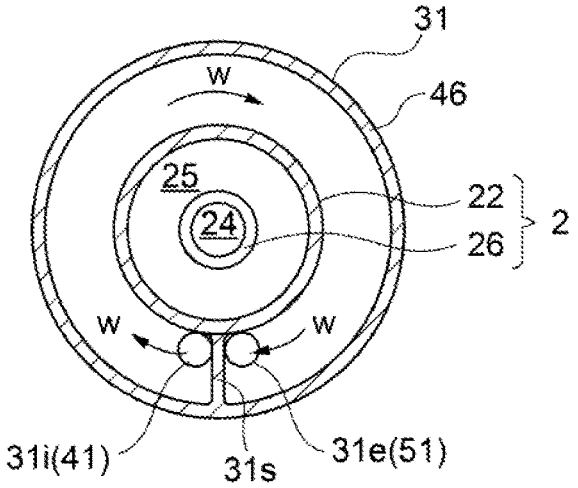
FIG. 5C is a cross-sectional view taken along line a-a of FIG. 5A.
Figure 5D:
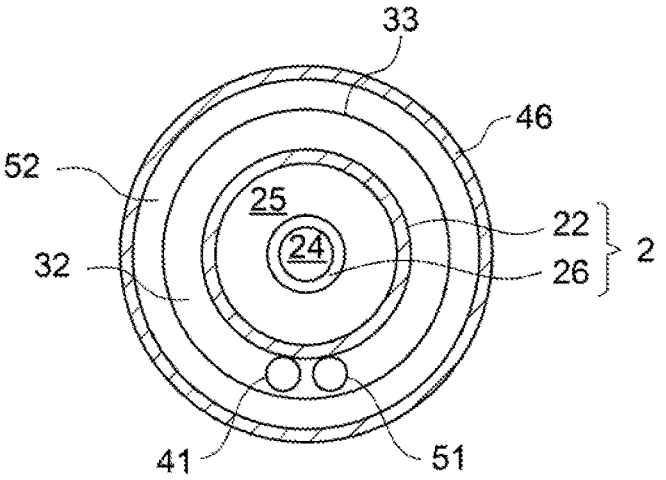
FIG. 5D is a cross-sectional view taken along line b-b of FIG. 5A.

FIG. 2A is an enlarged schematic view of an installation position of the burner device 1 including one cooling pipe in the combustion furnace of FIG. 1, and the burner device 1 protrudes from a recess portion 73. FIG. 2B is a cross-sectional view taken along line a-a of FIG. 2A. FIG. 3A is an enlarged schematic view of an installation position of the burner device 1 including a plurality of cooling pipes 3 in the combustion furnace 7 of FIG. 1, and the burner device 1 protrudes from the recess portion 73. FIG. 3B is a cross-sectional view taken along line a-a of FIG. 3A. FIG. 4 is an enlarged schematic view of an installation position of the burner device 1 according to an embodiment of the present invention, and the burner device 1 protrudes from not the recess portion 73 but the furnace wall 71. FIG. 5A is an enlarged schematic view of an installation position of the burner device 1 according to an embodiment of the present invention, and the cooling pipe 3 forms a cylindrical flow channel. FIG. 5B is a view of FIG. 5A as seen in a direction of an arrow A. FIG. 5C is a cross-sectional view taken along line a-a of FIG. 5A. In addition, FIG. 5D is a cross-sectional view taken along line b-b of FIG. 5A.

As shown in FIGS. 2A to 5D, the burner device 1 is a device installed so as to penetrate through an opening portion formed in the furnace wall 71 of the combustion furnace 7 and includes a burner body 2, the cooling pipe 3, and a light detection unit 6.

The above each component of the burner device 1 will be described below. In the description below, the burner device 1 will be described by taking the above-described powdered-coal burner 12 as an example. In some other embodiments, however, the burner device 1 may be a burner such as the powdered-coal burner 12, char burner 14, or gasification burner 16 used for the combustion furnace 7 as long as the burner device 1 includes the cooling pipe 3.

The burner body 2 includes a furnace protruding portion 22 which is a portion installed while penetrating through the opening portion formed in the furnace wall 71 of the combustion furnace 7, and is a portion protruding from the furnace wall 71 into the interior of the combustion furnace 7 when the burner body 2 is installed in the aforementioned opening portion (see FIGS. 2A, 3A, 4 and 5A). That is, the furnace protruding portion 22 is a portion from a base portion 22*b* to a tip portion 22*t* in the burner body 2. The base portion 22*b* includes the position (root) of the furnace wall 71 of the combustion furnace 7. In addition, the outer peripheral surface of the furnace protruding portion 22 is divided into a tip-side region R1 and a base-side region R2 between a tip side and a base side in a protruding direction, as will be described later. Then, since the furnace protruding portion 22 is positioned in the interior of the combustion furnace 7, the furnace protruding portion 22 is not only exposed to radiation and a thermal current caused by flame in the furnace but also subjected to a large heat load due to adhesion, separation, or the like of molten slag during operation of the combustion furnace 7. Therefore, the furnace protruding portion 22 is cooled by the cooling pipe 3 to be described later. In the embodiments shown in FIGS. 2A to 5D, a seal box (not shown) is disposed on the side of the exterior of the furnace of the combustion furnace 7. The seal box is filled with a refractory material (for example, alumina or SiC) to cover the opening portion. In the opening portion, a gap between the furnace wall 71 and the burner device 1 is filled with a refractory material 75.

In addition, in the embodiment shown in FIGS. 2A to 5D, the burner body 2 has a cylindrical shape. In addition, as shown in FIGS. 2A to 5D, the cylindrical burner body 2 internally includes a fuel supply pipe portion 26 having a cylindrical shape in its center. Then, a fuel supply passage 24 is formed inside the cylindrical fuel supply pipe portion 26.

The fuel supply passage 24 is configured such that powdered coal passes through by communicating with the above-described powdered-coal supply path 81. In addition, inside the burner body 2, the cylindrical fuel supply pipe portion 26 is disposed so as to be separated from a cylindrical outer wall, forming a cylindrical space serving as an oxidant supply passage 25 between a pipe wall of the cylindrical fuel supply pipe portion 26 and the outer wall of the burner body 2. Then, the oxidant supply passage 25 is configured such that an oxygen-containing gas passes through by communicating with the above-described oxidant supply path 82.

The cooling pipe 3 is configured such that a refrigerant W for cooling the burner body 2 flows through and are disposed in contact with the burner body 2 (furnace protruding portion 22) in order to cool the burner body 2. In some embodiments, as shown in FIGS. 2A and 2B, the furnace protruding portion 22 is surrounded by the one cooling pipe 3. The cooling pipe 3 includes a portion (tip-side cooling pipe 31) which surrounds the tip-side region R1 including the tip portion 22*t* on the outer peripheral surface of the furnace protruding portion 22, and a portion (base-side cooling pipe 32) which surrounds the base-side region R2 between the tip-side region R1 and the base portion 22*b* on the outer peripheral surface of the furnace protruding portion 22.

In some other embodiments, as shown in FIGS. 3A to 5D, the cooling pipe 3 includes two pipes; the above-described tip-side cooling pipe 31 and the base-side cooling pipe 32 disposed so as to surround the above-described base-side region R2. In this case, the tip-side cooling pipe 31 and the base-side cooling pipe 32 are different pipes independent of each other and are configured so as to make the refrigerant W flow by cooling systems independent of each other. That is, each of the tip-side cooling pipe 31 and the base-side cooling pipe 32 has an inlet and outlet for the refrigerant W. For example, neither an outlet 31*e* of the tip-side cooling pipe 31 and an inlet 32*i* of the base-side cooling pipe 32 are directly coupled to each other, nor an outlet 32*e* of the base-side cooling pipe 32 and an inlet 31*i* of the tip-side cooling pipe 31 are directly coupled to each other.

In the embodiments shown in FIGS. 2A to 5D, the base-side cooling pipe 32 is configured so as to surround not only the base-side region R2 of the furnace protruding portion 22 but also a portion of the burner body 2 positioned in the opening portion on the furnace wall 71 of the combustion furnace 7.

In addition, the above-described tip-side region R1 is a region including a partial region of the cooling pipe 3 where breakage particularly occurs due to the heat load during the operation of the combustion furnace 7, as will be described later. The base-side region R2 is a region which includes a portion excluding the tip-side region R1. In some embodiments, the tip-side region R1 of the furnace protruding portion 22 is positioned between the tip portion 22*t* and a position half the entire length of the furnace protruding portion 22 (a length corresponding to a length obtained by adding lengths indicated by R1 and R2 in FIGS. 2A, 3A, 4, and 5A). According to the above configuration, it is possible to reliably dispose the tip-side cooling pipe 31 in a region where breakage (hole) owing to wear is likely to occur, and it is possible to reliably dispose the base-side cooling pipe 32 in a region which is hardly subjected to wear. In addition, in some embodiments, the tip-side cooling pipe 31 and the base-side cooling pipe 32 may be formed of the same material. In some other embodiments, the tip-side cooling pipe 31 which is particularly subjected to wear may be formed of a material having higher wear resistance and heat resistance than those of the base-side cooling pipe 32.

In addition, a refrigerant supply pipe 4 is connected to an inlet 3*i* of the refrigerant W of the cooling pipe 3. The refrigerant supply pipe 4 is a pipe-shaped member which forms a flow channel for supplying the refrigerant W to the cooling pipe 3.

In some embodiments, as shown in FIGS. 2A and 2B, the one refrigerant supply pipe 4 is connected to the inlet 31*i* of the cooling pipe 3 (the inlet 31*i* of the tip-side cooling pipe 31), and the refrigerant W which has flowed through the refrigerant supply pipe 4 is supplied from the above-described inlet 31*i* to the cooling pipe 3 (tip-side cooling pipe 31). Then, the refrigerant W supplied to the cooling pipe 3 is discharged to, for example, the exterior of the furnace via a refrigerant discharge pipe 5 which is connected to an outlet 3*e* (the outlet 32*e* of the base-side cooling pipe 32) serving as a discharge port to the outside of the pipe after passing through a portion of the tip-side cooling pipe 31 and a portion of the base-side cooling pipe 32 in this order.

In some other embodiments, as shown in FIGS. 3A to 5D, the cooling pipe 3 includes a first refrigerant supply pipe 41 and a second refrigerant supply pipe 42. The first refrigerant supply pipe 41 is a refrigerant supply pipe 4 for supplying the refrigerant W to the tip-side cooling pipe 31 and is connected to the tip-side cooling pipe 31, thereby being configured to supply the refrigerant W to the tip-side cooling pipe 31 from a side of the inlet 31*i* thereof. Then, the refrigerant W supplied to the tip-side cooling pipe 31 is discharged to, for example, the exterior of the furnace via the first refrigerant discharge pipe 51 connected to an outlet 31*e* thereof after passing through the tip-side cooling pipe 31.

On the other hand, the second refrigerant supply pipe 42 is the refrigerant supply pipe 4 for supplying the refrigerant W to the base-side cooling pipe 32 and is connected to the base-side cooling pipe 32, thereby being configured to supply the refrigerant W to the base-side cooling pipe 32 from a side of the inlet 32*i* thereof. Then, the refrigerant W supplied to the base-side cooling pipe 32 is discharged to, for example, the exterior of the furnace via a second refrigerant discharge pipe 52 connected to the outlet 32*e* thereof after passing through the base-side cooling pipe 32.

In any of the above-described embodiments, the refrigerant W is made to flow from the side of the tip portion 22*t* to the side of the base portion 22*b* of the furnace protruding portion 22 in order to efficiently cool the side of the tip portion 22*t* by the lower-temperature refrigerant W. Nevertheless, the present embodiment is not limitative. In some other embodiments, the refrigerant W may be made to flow from the side of the base portion 22*b* to the side of the tip portion 22*t* of the furnace protruding portion 22.

In the embodiments shown in FIGS. 2A to 5D, a refrigerant supply device 9 is used to supply the refrigerant W to the refrigerant supply pipe 4 (the first refrigerant supply pipe 41 and the second refrigerant supply pipe 42). The refrigerant supply device 9 may be configured to supply the refrigerant W from, for example, a storage tank 91 installed in the exterior of the combustion furnace 7 or the like by using a pump 92 or the like. In addition, in the embodiments shown in FIGS. 2A to 5D, a system circulates the refrigerant W such that after being discharged from the cooling pipe 3 by using the refrigerant discharge pipe 5 (the first refrigerant discharge pipe 51 and the second refrigerant discharge pipe 52) and being cooled, the refrigerant W is supplied to the refrigerant supply pipe 4 (the first refrigerant supply pipe 41 and the second refrigerant supply pipe 42) again. At this time, in the embodiments shown in FIGS. 3A to 5D, as shown in FIGS. 3A, 4 and 5A, a flow channel circulated from the first refrigerant discharge pipe 51 to the tip-side cooling pipe 31 and a flow channel circulated from the second refrigerant discharge pipe 52 to the tip-side cooling pipe 31 may respectively be formed of individual lines (pipes). Alternatively, in some other embodiments, a configuration may be possible, which branches from a branch part of a commonalized circulation flow channel, which is disposed at an appropriate position, for example, on an upstream side of the storage tank 91, on an upstream side of the pump 92, or the like to the first refrigerant supply pipe 41 and the second refrigerant supply pipe 42. In addition, in the embodiments shown in FIGS. 2A to 5D, the burner device 1 may include two or more cooling systems by disposing one or more cooling systems in at least one of the tip-side region R1 or the base-side region R2.

The light detection unit 6 detects internal light of the cooling pipe 3. As shown in FIGS. 2A to 5D, at least a part (a light transmission member 61 of an optical fiber 62 of the light detection unit 6 in the embodiments shown in FIGS. 2A to 5D) of the light detection unit 6 is installed inside the cooling pipe 3. In some embodiments, as shown in FIGS. 2A to 5D, the light detection unit 6 is installed inside the tip-side cooling pipe 31 and is configured to detect internal light of the tip-side cooling pipe 31. In some other embodiments, the light detection unit 6 may be installed inside the base-side cooling pipe 32 and is configured to detect internal light of the base-side cooling pipe 32. In some other embodiments, the light detection unit 6 may be installed both inside the tip-side cooling pipe 31 and inside the base-side cooling pipe 32, and detects both the internal light of the tip-side cooling pipe 31 and the internal light of the base-side cooling pipe 32.

During the operation of the combustion furnace 7, if the cooling pipe 3 is broken by, for example, being worn and getting a hole due to radiation and a thermal current caused by flame in the furnace, slag generated in the furnace, or the like, light generated by combustion (flame) in the furnace reaches inside the cooling pipe 3 via a broken part (hole) thereof, further lightening the inside of the cooling pipe 3. The light detection unit 6 is configured so as to detect, by such breakage (hole) of the cooling pipe 3, a phenomenon in which the inside of the cooling pipe 3 is further lightened during the operation of the combustion furnace 7.

More specifically, while leakage of the refrigerant W from the cooling pipe 3 occurs due to breakage of the cooling pipe 3 and opening of the hole thereof, an influence by the leaked refrigerant W is small immediately after the cooling pipe is broken to a degree that the refrigerant W leaks from the cooling pipe 3, making it possible to continue the operation of the combustion furnace 7. However, as a result of further wearing the cooling pipe 3 with time, breakage (hole) in the cooling pipe 3 gradually grows, and the amount of the refrigerant W leaking from the cooling pipe 3 increases. Then, finally, an influence by the amount of the refrigerant W leaking from the cooling pipe 3 increases, running into a situation which needs the shutdown of the combustion furnace 7.

While the leakage of the refrigerant W from the cooling pipe 3 increases as described above, the leakage of the refrigerant W from the cooling pipe 3 has conventionally been detected by, for example, monitoring furnace conditions during the operation of the combustion furnace 7. More specifically, if the refrigerant W leaks from the cooling pipe 3, for example, a temperature in the furnace such as the combustor portion 7*c* decreases, causing a phenomenon in which a flow of the molten slag is worsened in the discharge port 72 or the like of the combustion furnace 7. In addition, a phenomenon is caused in which a component of a gasification gas rising up from the reductor portion 7*r* changes. More specifically, when the refrigerant W leaks, hydrogen or carbon dioxide serving as one component of a gasification gas and a water component increase as compared with a normal time, and in contrast, carbon monoxide decreases as compared with the normal time. However, such a change in furnace conditions cannot be detected unless the relatively large amount of the refrigerant W leaks from the cooling pipe 3. It is thus necessary to stop the combustion furnace 7 immediately after detecting the leakage.

However, with respect to such a conventional method, conditions (illuminance, a light intensity, and the like) of internal light of the cooling pipe 3, which is detected by using the light detection unit 6 change at a time when a hole is formed due to breakage of the cooling pipe 3. It is therefore possible to detect, by the light detection unit 6, the leakage of the refrigerant W from the cooling pipe 3 at an early stage.

According to the above configuration, the burner device 1 includes the light detection unit 6 for detecting the internal light of the cooling pipe 3, and it is possible to detect occurrence of breakage (hole) in the cooling pipe 3 at an earlier stage by monitoring the light detected by the light detection unit 6.

In addition, if the amount of the refrigerant W leaking from the cooling pipe 3 excessively increases, the shutdown of the combustion furnace 7 is inevitable. However, occurrence of breakage (hole) in the cooling pipe 3 is detected at the early stage, making it possible to place a moratorium from the detection to the shutdown of the combustion furnace 7. Accordingly, maintenance works such as preparation for replacements and specifying a portion to be checked are prepared in the moratorium, making it possible to shorten a non-operation time of the combustion furnace 7 as compared with a case in which the maintenance works are prepared, and the actual maintenance works are done after stopping the combustion furnace 7. Therefore, the combustion furnace 7 is stopped before damaging the burner body 2, making it possible to suppress a decrease in operation rate of the combustion furnace 1 caused by maintenance of the burner device 1 while avoiding damage to the burner body 2.

In addition, in some embodiments, as shown in FIGS. 2A to 3B, the furnace wall 71 of the combustion furnace 7 includes the recess portion 73 formed to be recessed toward the exterior of the furnace by being bent toward the exterior of the furnace. Then, the furnace protruding portion 22 protrudes from a bottom part 73*b* of the recess portion 73. As described above, the furnace protruding portion 22 protrudes from the recess portion 73 on the furnace wall 71 of the combustion furnace 7, allowing the recess portion 73 to mainly protect the base-side region R2 of the furnace protruding portion 22. In addition, it is possible to further narrow a worn part of the cooling pipe 3 to the tip-side region R1.

In some other embodiments, as shown in FIG. 4, the furnace wall 71 of the combustion furnace 7 is not formed in the above-described recess portion 73, and the furnace protruding portion 22 may protrude from the furnace wall 71 formed into a flat shape along a gravity direction.

Next, a specific configuration of the light detection unit 6 will be described.

In some embodiments, as shown in FIGS. 2A to 5D, the light detection unit 6 includes the light transmission member 61 for transmitting light, which is installed inside the cooling pipe 3 and a light detector 64 which detects inner light from the cooling pipe 3 transmitted by the light transmission member 61. In the embodiments shown in FIGS. 2A to 5D, the light transmission member 61 is the optical fiber 62. The optical fiber 62 is installed such that a distal end 62*t* of the optical fiber 62 (that is, the distal end 62*t* of the light transmission member 61) is positioned inside the cooling pipe 3, and the other end thereof is connected to the light detector 64. That is, the optical fiber 62 is configured to transmit (propagate), to the light detector 64, light entering from the distal end 62*t* to the inside of the optical fiber 62. As described above, the optical fiber 62 which can endure a high-temperature environment of the combustion furnace 7 is installed in the furnace, making it possible to appropriately transmit light in the cooling pipe 3 to the light detector 64. Nevertheless, the present embodiment is not limitative. In some other embodiments, the light transmission member 61 may include the light transmission member 61 other than the optical fiber 62.

On the other hand, in the embodiments shown in FIGS. 2A to 5D, the light detector 64 includes, for example, a light detection portion 65 such as a photo diode (semiconductor) which can detect light. Then, the light detector 64 and the optical fiber 62 (light transmission member 61) are connected such that the light transmitted (propagated) from the cooling pipe 3 by the optical fiber 62 enters the light detection portion 65. The light detector 64 (photo diode) passes a current corresponding to received light. Hence, the light detector 64 can detect conditions of internal light of the cooling pipe 3 based on a current value of the light detection portion 65. In addition, in the embodiments shown in FIGS. 2A to 5D, the light detector 64 is installed in the exterior of the furnace of the combustion furnace 7. As described above, the light detector 64 is installed not in the interior of the furnace in the high-temperature environment but in the exterior of the furnace at a relatively low temperature, making it possible to protect the light detector 64 from heat and improve reliability of the light detection unit 6.

According to the above configuration, the internal light of the cooling pipe 3 is transmitted to the light detector 64 by the light transmission member 61 (for example, the optical fiber 62), and the light detector 64 detects the internal light of the cooling pipe 3, monitoring and detecting breakage (hole) of the cooling pipe 3 during the operation of the combustion furnace 7. Thus, the light detection unit 6 can appropriately detect the internal light of the cooling pipe 3 without installing the light detector 64 in the high-temperature environment in the furnace, making it possible to appropriately detect breakage (hole) of the cooling pipe 3 during the operation of the combustion furnace 7.

In addition, in some embodiments, as shown in FIGS. 2A to 5D, the optical fiber 62 includes the plurality of optical fibers 62, and the distal ends 62*t* of the plurality of optical fibers 62 are respectively disposed at different positions from each other in the cooling pipe 3. The small number, such as one, of optical fibers 62 has competitive advantages such as simplification of the light detection unit 6 and a cost reduction. Nevertheless, the plurality of optical fibers 62 are installed as described above because the optical fibers 62 propagate light entering from the distal ends 62*t* to inside thereof. That is, the cooling pipe 3 is installed so as to surround the furnace protruding portion 22. It is relatively difficult for the optical fiber 62 whose distal end 62*t* is disposed at a certain position to receive light from breakage (hole) caused, for example, on an opposite side across the center of the burner body 2. The other optical fiber 62 covers for such light which is difficult to be received. Therefore, the respective distal ends 62*t* of the plurality of optical fibers 62 are disposed at the different positions from each other, making it possible to detect, with a high sensitivity, light from broken parts which may be caused at various positions of the cooling pipe 3 surrounding the furnace protruding portion 22.

In the embodiments shown in FIGS. 2A to 5D, the two optical fibers 62 are connected to the light detector 64. Then, as shown in FIGS. 2B, 3B, and 5C, defining an angle θ right-handed (clockwise) with respect to a horizontal line h passing through the center of the fuel supply passage 24 of the burner body 2, a first optical fiber 62*a*, that is, one of the plurality of optical fibers 62 is installed such that its distal end 62*t* is positioned in the vicinity of 0 degrees. Moreover, a second optical fiber 62*b*, that is, the other of the plurality of optical fibers 62 is installed such that its distal end 62*t* is positioned in the vicinity of 120 degrees. This is because breakage of the cooling pipe 3 which easily occurs during the operation of the combustion furnace 7 is likely to be obtained in a range from −30 degrees to 210 degrees, and thus this range is to be covered by the plurality of optical fibers 62.

Nevertheless, the present embodiment is not limitative. The distal ends 62*t* of one or more optical fibers 62 can be disposed anywhere in a range of 360 degrees. For example, in some other embodiments, the three optical fibers 62 may be disposed such that the distal ends 62*t* thereof are respectively positioned at −60 degrees, 60 degrees, and 180 degrees. In some other embodiments, the only one optical fiber 62 is used, and a position and orientation of the distal end 62*t* thereof may be set. For example, the distal end 62*t* of the optical fiber 62 may be disposed so as to face obliquely upward at positions of 30 degrees and 150 degrees. In addition, in some other embodiments, for example, one or more optical fibers 62 (distal ends 62*t*) may be disposed so that it is possible to detect, with a high sensitivity, light from a position where breakage of the cooling pipe 3 is likely to occur, which is specified based on a prior incident or the like.

Alternatively, in some other embodiments, in the one optical fiber 62, a plurality of portions (light entrance windows) obtained by partially removing a clad such that a core is exposed are formed, for example, at a predetermined interval or the like, and such an optical fiber 62 may be disposed along a flow channel of the cooling pipe 3. A disposed part may be at least a part such as the above-described range of the tip-side cooling pipe 31 or may be at least a part of the base-side cooling pipe 32 in addition to the tip-side cooling pipe 31. Each of the light entrance windows may be formed into an annular shape along a periphery of the optical fiber 62 or may be a part such as a portion facing an outer circumference of the cooling pipe 3 in the periphery. Therefore, a plurality of light entrance windows are disposed so as to face a plurality of different parts from each other on an outer peripheral wall of the cooling pipe 3 by installing the optical fiber 62 along a flow channel formed by the cooling pipe 3, making it possible to detect, with the high sensitivity, the light from the broken parts which may be caused at the various positions of the cooling pipe 3 surrounding the furnace protruding portion 22.

According to the above configuration, the plurality of optical fibers 62 can respectively monitor presence/absence of occurrence of breakage (hole) at the plurality of different positions from each other in the cooling pipe 3, making it possible to detect, with a higher sensitivity, a change in light generated by occurrence of breakage (hole) of the cooling pipe 3.

In the above-described embodiments shown in FIGS. 2A to 4, for example, the light transmission members 61 such as the optical fibers 62 are installed inside the cooling pipe 3 via the refrigerant supply pipe 4. In some other embodiments, as shown in FIGS. 5A to 5D, for example, the light transmission members 61 such as the optical fibers 62 may be installed inside the cooling pipe 3 via each of the refrigerant supply pipe 4 and the refrigerant discharge pipe 5. In some other embodiments, for example, the light transmission members 61 such as the optical fibers 62 may be installed from the side of the outlet 3*e* of the cooling pipe 3 to the inside via only the refrigerant supply pipe 5 or the like.

In addition, in some embodiments, as shown in FIGS. 2A to 5D, the light transmission members 61 are installed inside the tip-side cooling pipe 31. In other words, the light transmission members 61 are installed inside the cooling pipe 3 surrounding the tip-side region R1 on the outer peripheral surface of the furnace protruding portion 22. The burner device 1 is configured as described above because it was found that breakage (hole) of the cooling pipe 3 owing to radiation and the thermal current caused by flame in the furnace, the molten slag generated in the furnace, or the like is likely to occur especially in the cooling pipe 3 surrounding the tip-side region R1 of the outer peripheral surface of the furnace protruding portion 22.

According to the above configuration, the light transmission members 61 (for example, the optical fibers 62) are installed inside the tip-side cooling pipe 31 surrounding the tip-side region R1 of the furnace protruding portion 22. Therefore, it is possible to monitor breakage of the cooling pipe 3 only in a part with a higher possibility of breakage, making it possible to efficiently detect breakage of the cooling pipe 3 during the operation of the combustion furnace 7 at an early stage. The tip-side cooling pipe 31 and the base-side cooling pipe 32 may be the cooling pipes 3 connected to each other or may be the cooling pipes 3 independent of each other.

In the above embodiments, furthermore, as shown in FIGS. 3A to 5D, the burner device 1 may further include the first refrigerant supply pipe 41 for supplying the refrigerant W to the tip-side cooling pipe 31 and the second refrigerant supply pipe 42 for supplying the refrigerant W to the base-side cooling pipe 32. That is, in the embodiments shown in FIGS. 3A to 5D, the furnace protruding portion 22 of the burner body 2 includes two cooling systems; a cooling system (the tip-side cooling pipe 31 and the first refrigerant supply pipe 41) for cooling the tip-side region R1 and a cooling system (the base-side cooling pipe 32 and the second refrigerant supply pipe 42) for cooling the base-side region R2. Therefore, replacement or the like of only the tip-side cooling pipe 31 can be made, making it possible to efficiently do maintenance works and to further suppress the decrease in operation rate of the combustion furnace 7 owing to maintenance of the burner device 1. In addition, according to the above configuration, it is possible to provide the burner device 1 which can perform a refrigerant control method of the burner device 1 to be described later.

Next, some embodiments related to a structure of the cooling pipe 3 will be described.

In some embodiments, as shown in FIGS. 2A to 4, the base-side cooling pipe 32 is wound around the outer peripheral surface of the furnace protruding portion 22. In other words, the pipe-shaped base-side cooling pipe 32 is spirally wound a plurality of times in the base-side region R2 of the furnace protruding portion 22. On the other hand, in the embodiments shown in FIGS. 2A to 4, the tip-side cooling pipe 31 covers the tip-side region R1 by winding the pipe-shaped base-side cooling pipe 32 only by one round. Nevertheless, the present embodiment is not limitative. In some other embodiments, the tip-side region R1 may be covered by winding the tip-side cooling pipe 31 a plurality of times. Thus, it is possible to install the base-side cooling pipe 32 in the burner body 2.

In addition, in some other embodiments, as shown in FIGS. 5A to 5D, the base-side cooling pipe 32 forms a cylindrical flow channel for the refrigerant W to flow, which covers the base-side region R2. Specifically, the burner device 1 further includes an outer peripheral pipe 46 having a cylindrical shape, which is disposed so as to surround (cover) the outer peripheral surface of the burner body 2. Then, a cylindrical space is formed between the outer peripheral pipe 46 and the outer wall of the burner body 2 by surrounding the furnace protruding portion 22 with the outer peripheral pipe 46 (see FIGS. 5A, 5C, and 5D). Furthermore, the above cylindrical space formed by the burner body 2 and the outer peripheral pipe 46 is divided, by an internal wall 33 having a cylindrical shape, into a cylindrical inner space on the side of the burner body 2 and a cylindrical outer space positioned on an outer peripheral side thereof. In addition, the cylindrical inner space formed between the outer wall of the burner body 2 and the above internal wall 33, and the cylindrical outer space formed between the internal wall 33 and the outer peripheral pipe 46 are closed by a region boundary partition wall 47 on a boundary between the tip-side region R1 and base-side region R2 of the furnace protruding portion 22, and communicate with each other by a communication passage 48 formed on the side of the base portion 22*b* along the region boundary partition wall 47. Then, the refrigerant W is supplied from the second refrigerant supply pipe 42 to the cylindrical inner space formed as described above.

That is, the base-side cooling pipe 32 surrounding the base-side region R2 on the outer peripheral surface of the furnace protruding portion 22 is formed by the base-side region R2 on the outer peripheral surface of the furnace protruding portion 22, the above internal wall 33 positioned on an outer peripheral side thereof, and the region boundary partition wall 47. Thus, it is possible to install the base-side cooling pipe 32 in the burner body 2. In addition, the second refrigerant discharge pipe 52 is formed by the above internal wall 33, the outer peripheral pipe 46 positioned on an outer peripheral side thereof, and the region boundary partition wall 47. Therefore, as shown in FIG. 5A, the refrigerant W supplied from the second refrigerant supply pipe 42 flows through a cylindrical flow channel from the side of the base portion 22*b* to the side of the tip portion 22*t*. The cylindrical flow channel is formed by the base-side cooling pipe 32 surrounding the base-side region R2 of the furnace protruding portion 22. Subsequently, through the communication passage 48, the refrigerant W flows into the second refrigerant discharge pipe 52 formed along the outside of the base-side cooling pipe 32 and flows through the second refrigerant discharge pipe 52 from the side of the tip portion 22*t* toward the side of the base portion 22*b*.

On the other hand, in the embodiments shown in FIGS. 5A to 5D, the above-described outer peripheral pipe 46 positioned on the outer peripheral side of the furnace protruding portion 22 extends to the tip portion 22*t* of the furnace protruding portion 22 over the above region boundary partition wall 47, and the tip of the outer peripheral pipe 46 and the tip portion 22*t* of the furnace protruding portion 22 are closed by being coupled to each other by a sealing wall 49 extending in a radial direction of the cylindrical furnace protruding portion 22. That is, the annular tip-side cooling pipe 31 surrounding the tip-side region R1 is formed by the tip-side region R1 on the outer peripheral surface of the furnace protruding portion 22, the outer peripheral pipe 46 positioned on an outer peripheral side thereof, the region boundary partition wall 47, and the sealing wall 49 (see FIGS. 5A and 5B).

In addition, as shown in FIG. 5C, the inside of the tip-side cooling pipe 31 formed into the annular shape is divided by a partition wall 31*s*. Thus, the refrigerant W entering from the inlet 31*i* via the first refrigerant supply pipe 41 flows inside the tip-side cooling pipe 31 so as to bypass the partition wall 31*s*, heading for the outlet 31*e*. In the embodiments shown in FIGS. 5A to 5D, as shown in FIG. 5C, because the inlet 31*i* and outlet 31*e* of the tip-side cooling pipe 31 are disposed to be adjacent to each other across the partition wall 31*s*, the refrigerant W flows through the tip-side cooling pipe 31 from the inlet 31*i* to the outlet 31*e* so as to make a circuit of the outer peripheral of the furnace protruding portion 22.

Then, as shown in FIGS. 5A, 5C, and 5D, the first refrigerant supply pipe 41 is installed inside a flow channel formed by the base-side cooling pipe 32. That is, the first refrigerant supply pipe 41 extends from the side of the base portion 22*b* to the side of the tip portion 22*t* of the furnace protruding portion 22 inside the base-side cooling pipe 32 and is connected to the tip-side cooling pipe 31 in an end portion on the side of the tip portion 22*t*. In addition, the first refrigerant supply pipe 51 is also installed inside the flow channel formed by the base-side cooling pipe 32. Thus, it is possible to further reduce a size of the burner device 1 as compared with a case in which the first refrigerant supply pipe 41 and the first refrigerant discharge pipe 51 are installed outside the base-side cooling pipe 32.

Figure 6:
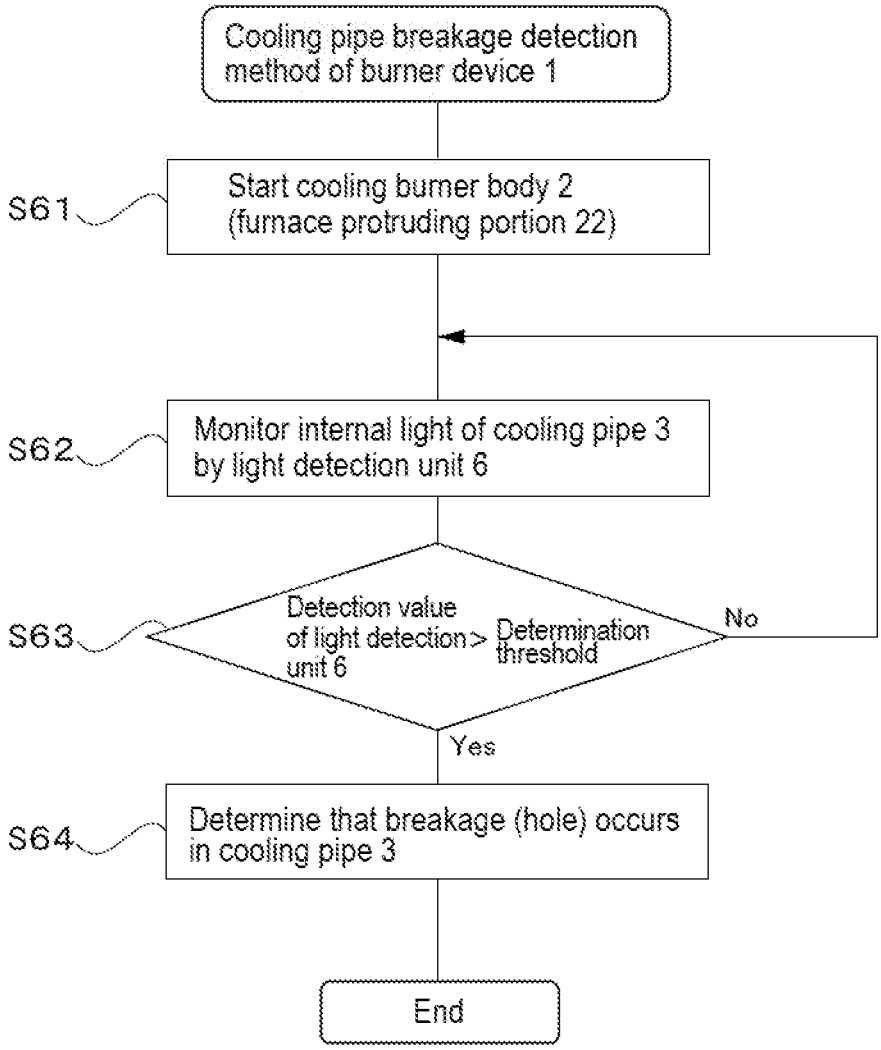
FIG. 6 is a flowchart showing a cooling pipe breakage detection method of the burner device according to an embodiment of the present invention.

The burner device 1 according to some embodiments of the present invention has been described above. Next, a cooling pipe breakage detection method of the burner device 1 will be described with reference to FIG. 6. The method detects breakage of the cooling pipe 3 (the tip-side cooling pipe 3 and the base-side cooling pipe 32) of the burner device 1 having the above-described configuration. FIG. 6 is a flowchart showing the cooling pipe breakage detection method of the burner device 1 according to an embodiment of the present invention. As shown in FIG. 6, the cooling pipe breakage detection method of the burner device 1 includes a burner body cooling step (S61), a cooling pipe internal light monitoring step (S62), and breakage determination steps (S63 and S64). The cooling pipe breakage detection method of the burner device 1 according to an embodiment of the present invention will be described below with reference to the flow of FIG. 6.

The burner body cooling step is performed in step S61 of FIG. 6. The burner body cooling step (S61) is a step of supplying the refrigerant W to the cooling pipe 3. In other words, the burner body cooling step (S61) is a step of starting to cool the burner body 2 (the tip-side region R1 and the base-side region R2 serving as the outer peripheral surface of the furnace protruding portion 22). In the embodiments shown in FIGS. 2A and 2B, when the refrigerant W is supplied to the cooling pipe 3 via the refrigerant supply pipe 4, the refrigerant W sequentially flows through a portion of the tip-side cooling pipe 31 and a portion of the base-side cooling pipe 32 in the cooling pipe 3, cooling the burner body 2. On the other hand, in the embodiments shown in FIGS. 3A to 5D, the refrigerant W is supplied to the tip-side cooling pipe 31 via the first refrigerant supply pipe 41, cooling the tip-side region R1 of the furnace protruding portion 22. In addition, the refrigerant W is supplied to the base-side cooling pipe 32 via the second refrigerant supply pipe 42, cooling the base-side region R2 of the furnace protruding portion 22. Consequently, the burner body 2 is cooled. More specifically, in some embodiments, the pump 92 may start to flow the refrigerant W through the refrigerant supply pipe 4. In some other embodiments, the burner body cooling step (S61) may be performed by, together with the start of the pump 92, opening a flow-rate control valve 94 which is installed in the refrigerant supply pipe 4 and can control the flow rate of the refrigerant W. The burner body cooling step (S61) may be performed together with the start of the operation of the combustion furnace 7.

The cooling pipe internal light monitoring step is performed in step S62 of FIG. 6. The cooling pipe internal light monitoring step (S62) is a step of monitoring internal light of the cooling pipe 3 by the above-described light detection unit 6. More specifically, the cooling pipe internal light monitoring step (S62) monitors the internal light by, for example, periodically checking a detection value of the light detector 64.

Then, in steps S63 and S64, the breakage determination steps are performed. The breakage determination steps (S63 and S64) are steps of determining, based on a monitoring result by the above cooling pipe internal light monitoring step (S62), whether breakage occurs in the cooling pipe 3. As described above, if breakage (hole) occurs in the cooling pipe 3, the conditions (the illuminance, light intensity, and the like) of internal light of the cooling pipe 3, which is detected by using the light detection unit 6 grows as compared with a normal time without any breakage (hole) occurring in the cooling pipe 3. Therefore, it is determined that breakage occurs in the cooling pipe 3 if the detection value of the light detection unit 6 becomes larger than a determination threshold which can be determined as the normal time, and it is determined that breakage does not occur in the cooling pipe 3 if the detection value is equal to or smaller than the determination threshold. More specifically, in step S63, the above determination threshold and the detection value of the light detection unit 6 obtained by the cooling pipe internal light monitoring step are compared. If the detection value of the light detection unit 6 is equal to or smaller than the determination threshold as a result of the comparison, it can be determined that breakage does not occur in the cooling pipe 3, and thus the flow returns to step S62. In contrast, if the detection value of the light detection unit 6 is larger than the determination threshold in the comparison in step S63, it is determined in step S64 that breakage (hole) occurs in the cooling pipe 3. The flow of FIG. 6 is ended after step SM. The flow of FIG. 6 is also ended when the combustion furnace 7 is shut down.

According to the above configuration, it is possible to detect occurrence of breakage (hole) in the cooling pipe 3 at an earlier stage by monitoring light detected by the light detection unit 6.

Figure 7:
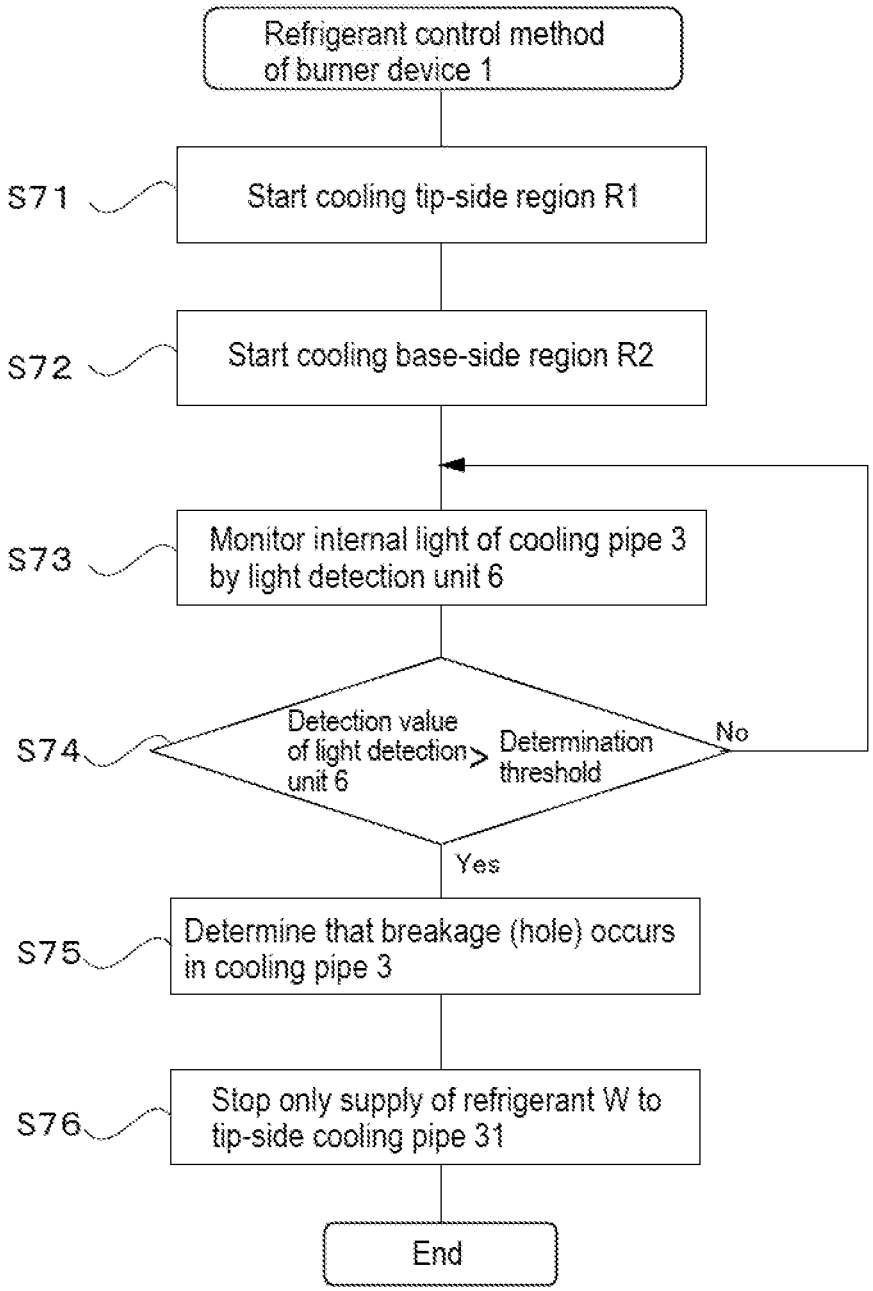
FIG. 7 is a flowchart showing a refrigerant control method of the burner device according to an embodiment of the present invention.

Next, a refrigerant control method of the burner device will be described with reference to FIG. 7. The method controls supply of the refrigerant W to the cooling pipe 3 (the tip-side cooling pipe 31 and the base-side cooling pipe 32) of the burner device 1 including the plurality of cooling systems as shown in FIGS. 3A to 5D. FIG. 7 is a flowchart showing the refrigerant control method of the burner device 1 according to an embodiment of the present invention. As shown in FIG. 7, the refrigerant control method of the burner device 1 includes a tip-side region cooling step (S71), a base-side region cooling step (S72), a cooling pipe internal light monitoring step (S73), breakage determination steps (S74 and S75), and a tip-side region cooling stop step (S76). The refrigerant control method of the burner device 1 according to an embodiment of the present invention will be described below with reference to the flow of FIG. 7.

The tip-side region cooling step is performed in step S71 of FIG. 7. The tip-side region cooling step (S71) is a step of supplying the refrigerant W from the first refrigerant supply pipe 41 to the tip-side cooling pipe 31. In other words, the tip-side region cooling step (S71) is a step of starting to cool the tip-side region R1. In addition, the base-side region cooling step is performed in step S72. The base-side region cooling step (S72) is a step of supplying the refrigerant W from the second refrigerant supply pipe 42 to the base-side cooling pipe 32. In other words, the base-side region cooling step (S72) is a step of starting to cool the base-side region R2. More specifically, in some embodiments, the pump 92 may start to flow the refrigerant W through the first refrigerant supply pipe 41 and the second refrigerant supply pipe 42. In some other embodiments, the tip-side region cooling step (S71) and the base-side region cooling step (S72) may be performed by, together with the start of the pump 92, opening the flow-rate control valve 94 and a flow-rate control valve 95 which are respectively installed in the first refrigerant supply pipe 41 and the second refrigerant supply pipe 42, and can control the flow rate of the refrigerant W. These steps (S71 and S72) may be performed together with the start of the operation of the combustion furnace 7. The tip-side region cooling step (S71) and the base-side region cooling step (S72) may simultaneously be performed, or the tip-side region cooling step (S71) may be performed after the base-side region cooling step (S72).

The cooling pipe internal light monitoring step is performed in step S73. The cooling pipe internal light monitoring step (S73) is a step of monitoring internal light of the cooling pipe 3 by the above-described light detection unit 6. The present step is the same as the cooling pipe internal light monitoring step (S62 of FIG. 6) described with reference to FIG. 6, and thus not described again in detail.

Then, the breakage determination steps are performed in steps S74 and S75. The breakage determination steps (S74 and S75) are steps of determining, based on a monitoring result by the above cooling pipe internal light monitoring step (S73), whether breakage occurs in the cooling pipe 3. The present steps (S74 and S75) are the same as the breakage determination steps (S63 and S64 of FIG. 6) described with reference to FIG. 6, and thus not described again in detail.

Subsequently, the tip-side region cooling stop step is performed in step S76. The tip-side region cooling stop step (S76) is a step of stopping only supply of the refrigerant W to the tip-side cooling pipe 31 if it is determined in the breakage determination steps (S74 and S75) that breakage occurs in the tip-side cooling pipe 31. That is, while supply of the refrigerant W to the tip-side cooling pipe 31 is stopped, supply of the refrigerant W to the base-side cooling pipe 32 is continued. More specifically, for example, in some embodiments, the pump 92 for supplying the refrigerant W to the first refrigerant supply pipe 41 connected to the tip-side cooling pipe 31 may be stopped. In some other embodiments, supply of the refrigerant W to the tip-side cooling pipe 31 may be stopped by closing the flow-rate control valve 94 installed in the first refrigerant supply pipe 41. Supply of the refrigerant W to the base-side cooling pipe 32 is continued. That is, a situation is obtained in which the operation of the combustion furnace 7 is continued while supply of the refrigerant W to the tip-side cooling pipe 31 is stopped, and supply of the refrigerant W to the base-side cooling pipe 32 is continued.

Then, the flow of FIG. 7 is ended after the above step S76. After step S76, maintenance works such as procurement of replacement members and arrangements for workers are prepared while continuing the operation of the combustion furnace 7 in the above situation. Then, after the preparation is completed, the combustion furnace 7 is shut down to do actual maintenance works. The above-described tip-side region cooling stop step (S76) of FIG. 7 may be performed if necessary for the preparation of the maintenance works. More specifically, if it is determined that the shutdown of the combustion furnace 7 is needed due to an influence of water leakage of the refrigerant W from the tip-side cooling pipe 31, the tip-side region cooling stop step (S76) may be performed.

According to the above configuration, in the burner device 1, the cooling pipe 3 of the furnace protruding portion 22 is provided as a separate system for each of the tip-side region R1 and the base-side region R2. It is therefore possible to stop only supply of the refrigerant W to the tip-side cooling pipe 31 where the light detection unit 6 is installed if the light detection unit 6 determines that breakage (hole) occurs in the cooling pipe 3. That is, in this case, it is possible to continue cooling the burner body 2 by the base-side cooling pipe 32 while stopping leakage of the refrigerant W from the tip-side cooling pipe 31 to the furnace by stopping supply of the refrigerant W to the tip-side cooling pipe 31 where the light detection unit 6 is installed. In other words, it is possible to delay the shutdown of the combustion furnace 7 without the immediate shutdown thereof by avoiding heat damage to the burner body 2 by cooling with the base-side cooling pipe 32. That is, it is possible to further extend a moratorium from detection of leakage of the refrigerant W from the tip-side cooling pipe 31 to the shutdown of the combustion furnace 7 and to take a sufficient time for preparing maintenance.

Embodiments of the present invention were described in detail above, but the present invention is not limited thereto, and various amendments and modifications may be implemented.

For example, in the above-described embodiments, the combustion furnace 7 is described as the gasification furnace. However, the combustion furnace 7 may be a wet-type furnace which internally accommodates molten slag, such as a gasification melting furnace or a melting furnace installed in a melting plant for industrial waste. In addition, in the above-described embodiments, the burner device 1 of a gasification furnace which gasifies coal fuel is described as an example. However, the burner device 1 may be of a gasification furnace (combustion furnace 7) for gasifying other fuel such as biomass fuel.

REFERENCE SIGNS LIST

1 Burner device
12 Powdered-coal burner
14 Char burner
16 Gasification burner
2 Burner body
22 Furnace protruding portion
22*b* Base portion
22*t* Tip portion
24 Fuel supply passage
25 Oxidant supply passage
26 Fuel supply pipe portion
3 Cooling pipe
3*i* Inlet of cooling pipe
3*e* Outlet of cooling pipe
31 Tip-side cooling pipe
31*i* Inlet of tip-side cooling pipe
31*e* Outlet of tip-side cooling pipe
32 Base-side cooling pipe
32*i* Inlet of base-side cooling pipe
32*e* Outlet of base-side cooling pipe
31*s* Partition wall
33 Internal wall
4 Refrigerant supply pipe
41 First refrigerant supply pipe
42 Second refrigerant supply pipe
46 Outer peripheral pipe
47 Region boundary partition wall
48 Communication passage
49 Sealing wall
5 Refrigerant discharge pipe
51 First refrigerant discharge pipe
52 Second refrigerant discharge pipe
6 Light detection unit
61 Light transmission member
62 Optical fiber
62*a* First optical fiber
62*b* Second optical fiber
62*t* Distal end
64 Light detector
7 Combustion furnace
7*c* Combustor portion
7*r* Reductor portion
71 Furnace wall
72 Discharge port
73 Recess portion
73*b* Bottom part of recess portion
75 Refractory material
81 Powdered-coal supply path
82 Oxidant supply path
83 Char supply flow channel
9 Refrigerant supply device
91 Storage tank
92 Pump
94 Flow-rate control valve
95 Flow-rate control valve
R1 Tip-side region
R2 Base-side region
W Refrigerant
h Horizontal line passing through center of fuel supply passage

The invention claimed is:

1. A burner device comprising:
a furnace wall of a combustion furnace;
a burner body which includes a furnace protruding portion protruding from the furnace wall into an interior of the combustion furnace;
a cooling pipe through which a refrigerant for cooling the burner body flows, the cooling pipe being disposed so as to surround an outer peripheral surface of the furnace protruding portion; and
a light detection unit for detecting internal light of the cooling pipe,
the light detection unit including
an optical fiber for transmitting light, the optical fiber being installed inside the cooling pipe,
a light detector detecting inner light from the cooling pipe, the inner light being transmitted by the optical fiber, and
a refrigerant supply pipe forming a flow channel for supplying the refrigerant to an inlet of the cooling pipe,
wherein a distal end of the optical fiber is installed inside a portion disposed so as to surround an outer peripheral surface of the furnace protruding portion in the cooling pipe,
wherein the cooling pipe is spirally wound a plurality of times in the furnace protruding portion,
wherein the inlet of the cooling pipe is located closer to a tip side of the furnace protruding portion than an outlet of the cooling pipe, and
wherein the optical fiber passes through the refrigerant supply pipe and is inserted into the cooling pipe through the inlet of the cooling pipe.

2. The burner device according to claim 1,
wherein the optical fiber includes a plurality of optical fibers, and wherein respective distal ends of the plurality of optical fibers are disposed at different positions from each other in the cooling pipe.

3. The burner device according to claim 1, wherein the cooling pipe includes a tip-side cooling pipe through which a refrigerant for cooling the burner body flows, the tip-side cooling pipe being disposed so as to surround a tip-side region including a tip portion on an outer peripheral surface of the furnace protruding portion, and a base-side cooling pipe through which the refrigerant flows, the base-side cooling pipe being disposed so as to surround a base-side region between the tip-side region and a base portion on the outer peripheral surface of the furnace protruding portion, and wherein the optical fiber is installed inside the tip-side cooling pipe.

4. The burner device according to claim 3, wherein the burner device further includes a first refrigerant supply pipe for supplying the refrigerant to the tip-side cooling pipe and a second refrigerant supply pipe for supplying the refrigerant to the base-side cooling pipe.

5. The burner device according to claim 1, wherein the optical fiber includes a plurality of portions obtained by partially removing a clad which covers a core of the optical fiber such that the core is exposed.

6. The burner device according to claim 1, wherein the combustion furnace is a gasification furnace gasifying fuel.

7. A cooling pipe breakage detection method of a burner device for detecting breakage of a cooling pipe of the burner device according to claim 1, the method comprising:

a burner body cooling step of supplying the refrigerant to the cooling pipe;

a cooling pipe internal light monitoring step of monitoring internal light of the cooling pipe by the light detection unit; and a breakage determination step of determining, based on a monitoring result by the cooling pipe internal light monitoring step, whether breakage occurs in the cooling pipe.

8. A refrigerant control method of a burner device for controlling supply of a refrigerant to a cooling pipe of the burner device according to claim 7, the method comprising:

a tip-side region cooling step of supplying the refrigerant from the first refrigerant supply pipe to the tip-side cooling pipe;

a base-side region cooling step of supplying the refrigerant from the second refrigerant supply pipe to the base-side cooling pipe, a cooling pipe internal light monitoring step of monitoring internal light of the cooling pipe by the light detection unit;

a breakage determination step of determining, based on a monitoring result by the light monitoring step, whether breakage occurs in the tip-side cooling pipe; and a tip-side region cooling stop step of stopping only supply of the refrigerant to the tip-side cooling pipe if it is determined in the breakage determination step that breakage occurs in the tip-side cooling pipe.

* * * * *